US006475038B1

(12) United States Patent
Franck

(10) Patent No.: US 6,475,038 B1
(45) Date of Patent: Nov. 5, 2002

(54) CONNECTOR TERMINAL

(75) Inventor: Felix Franck, Munich (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 37 days.

(21) Appl. No.: 09/693,972

(22) Filed: Oct. 23, 2000

(30) Foreign Application Priority Data

Oct. 27, 1999 (DE) ..... 199 51 789

(51) Int. Cl.[7] ..... H01R 4/36
(52) U.S. Cl. ..... 439/811
(58) Field of Search ..... 439/727, 728, 439/729, 801, 810, 811, 812

(56) References Cited

U.S. PATENT DOCUMENTS

| | | | | | |
|---|---|---|---|---|---|
| 4,929,198 | A | * | 5/1990 | Strate et al. | 439/709 |
| 5,206,789 | A | * | 4/1993 | Barbry | 361/355 |
| 5,249,989 | A | * | 10/1993 | Alsch | 439/812 |
| 5,314,360 | A | * | 5/1994 | Jaag | 439/811 |
| 5,553,787 | A | * | 9/1996 | Guginsky | 439/472 |
| 5,664,971 | A | * | 9/1997 | Coy | 439/811 |
| 6,061,230 | A | * | 5/2000 | Mazella et al. | 361/627 |
| 6,231,405 | B1 | * | 5/2001 | Diconne et al. | 439/812 |

FOREIGN PATENT DOCUMENTS

| | | |
|---|---|---|
| DE | 1 238 534 | 4/1967 |
| DE | 32 08 065 | 9/1983 |
| DE | 39 01 307 | 7/1990 |
| DE | 44 39 379 | 5/1996 |
| DE | 197 53 078 | 6/1999 |
| DE | 197 53 076 | 8/1999 |
| EP | 0 157 123 | 10/1985 |

* cited by examiner

*Primary Examiner*—Brian Sircus
*Assistant Examiner*—Thanh-Tam Le
(74) *Attorney, Agent, or Firm*—Carlo S. Bessone

(57) ABSTRACT

The invention relates to a connecting terminal having a housing (14) in which a lift cage (22) is arranged, with the housing (14) and the lift cage (22) each having a first opening (20,21) which can be aligned such that it is flush, for inserting a cable end (24) into the lift cage (22), in which the housing (14) and the lift cage (22) each have a second opening (36,37), which can be aligned such that it is flush, for inserting at least one part **(30*a*,30*b*) of a circuit board (10) into the lift cage (22). It also relates to a system for producing a conductive connection between at least one part (30*a*,30*b*) of a circuit board and a connecting terminal according to the invention, in which case the system furthermore comprises a U-shaped crushing protection device (38) which can be pushed over that part (30*a*,30*b*) of the circuit board (10) which can be inserted into the connecting terminal in order to produce a conductive connection to the cable end (24). The invention furthermore relates to a circuit board for use with a connecting terminal according to the invention or for use in the system according to the invention, in which case the circuit board (10) has at least one projection (30*a*,30*b*) which is in the form of a finger and can be inserted into the connecting terminal in order to produce a conductive connection to a cable end (24)**.

11 Claims, 8 Drawing Sheets

Section B-B

Section D-D

Section C-C

Section D-D

Section C-C

Section D-D

Section C-C

Section D-D

Section C-C

CONNECTOR TERMINAL

The present invention relates to a connecting terminal having a housing in which a lift cage is arranged, with the housing and the lift cage each having a first opening which can be aligned such that it is flush, for inserting a cable end into the lift cage.

Such connecting terminals are generally known, and are illustrated in the form of a specific embodiment in FIGS. 1A,1B ,2A ,2B.

Against the background of other connecting terminals which are known from the prior art and are mounted by means of at least one solder pin per pole on the board of an electronic circuit, these connecting terminals form an improvement with regard to mechanical and electrical reliability. In FIG. 1A, the reference number 10 denotes a circuit board having one or more layers, or a busbar. Openings 12*a*,12*b* are provided in the circuit board 10. Two screws 16*a*,16*b* are recessed in the housing 14.

FIG. 1B shows a section along the line A—A in FIG. 1A. This shows the opening 12*b* in the circuit board 10 and the screw 16*b*, which is recessed in the housing 14 and presses against a solder pin 18 which is formed in a meandering shape. The housing 14 has an opening 20 for inserting a cable end 24 (see FIG. 2B). Arranged in the housing 14 is a lift cage 22, which can be moved relative to the housing 14 by rotating the screw 16*b*. Located in the lift cage 22 is an opening 21, which can be aligned with the opening 20 of the housing 14 such that they are flush.

FIGS. 2A and 2B correlate with the illustrations in FIG. 1A and FIG. 1B, although a cable end 24 has now been inserted into the opening 20 in the housing 14 and into the opening 21 in the lift cage 22, the solder pin 18 has been inserted into the opening 12*b*, and has been fixed in this position by means of solder 26. The cable end 24 is now—once the lift cage 22 has been moved upwards by rotation of the screw 16*b*—conductively connected to the solder pin 18. The solder pin 18 is in turn conductively connected via the solder 26 to a conductor track 28 on the circuit board 10. The meandering shape of the solder pin 18 increases the torsional elasticity and thus avoids stressing the solder point.

Against the background of this prior art, the present invention is based on the object of developing a connecting terminal of this generic type in such a way that the electrical resistance caused by the solder point is reduced.

This object is achieved by a connecting terminal having the features of Patent Claim 1. Since the housing and the lift cage have a second opening which can be aligned such that it is flush, and through which at least one part of a circuit board can be inserted into the lift cage, this makes it possible for a conductor track on the circuit board to be pressed conductively against a cable end by means of a different point on the lift cage. Since there is no need whatsoever for any solder pin, the production costs are reduced. Since there is no longer any need to carry out any soldering, the electrical resistance of the solder point disappears completely.

In order that a part of a circuit board can be inserted into the connecting terminal, it is particularly advantageous for the circuit board edge to be shaped in the form of a finger. This configuration and the fact that the terminal housing projects at right angles between a number of such fingers of the circuit board result in the air gap and creepage distances, and hence the withstand voltage between the individual poles of the terminal, being increased in an advantageous manner, where a number of individual terminals according to the invention are combined in a common housing. The connecting terminal is in this case advantageously made of insulating material.

In one particularly advantageous embodiment, the first and the second opening in the lift cage are designed, and connected to one another, and these two openings merge into one another, in such a way that a conductive connection can be produced between the cable end and a conductor track on that part of the circuit board. The lift cage can be moveable with respect to the first and the second opening in the housing, in particular by rotation of a screw, in such a way that the conductive connection between the cable end and the conductor track can be fixed. Alternatively, the mobility of the lift cage can be provided by a spring, which is located in a first position for inserting the circuit board and the cable end, and is located in a second position for fixing the cable end and the circuit board. To make operation easy, it has been found to be advantageous to arrange the first and the second opening on diametrically opposite sides of the housing and of the lift cage. However, a particularly robust embodiment results if the first and the second opening are arranged on the same side of the housing and of the lift cage, in particular being formed by a common opening.

To improve the fixing of the connection between the circuit board and the housing, the housing may have latching means which interact with the circuit board. In particular for relatively weak circuit board material, it is possible to provide, in order to produce a conductive connection between at least one part of the circuit board and a connecting terminal according to the invention, that a U-shaped crushing protection device can be pushed over that part of the circuit board which can be inserted into the connecting terminal in order to produce a conductive connection to the cable end.

The crushing protection device may in this case have a tilting protection apparatus which prevents tilting of at least that part of the circuit board which is inserted into the connecting terminal. A projection in the housing of the connecting terminal can interact with a cut-out in the crushing protection device for this purpose. A projection on the crushing protection device and a cut-out in the connecting terminal which interacts with it have the same effect, of course.

The crushing protection device can be produced from an electrically conductive and/or resilient material and may have latching means which interact with the housing in order to fix the crushing protection device in the housing.

The invention also comprises a circuit board for use with a connecting terminal according to the invention or for use in a system comprising a connecting terminal according to the invention and a crushing protection device, in which case the circuit board has at least one projection which is in the form of a finger and can be inserted into the connecting terminal in order to produce a conductive connection to a cable end. The projection which is in the form of a finger may have latching means which interact with the latching means on the housing of the connecting terminal. It may also have a tilting protection apparatus, which prevents tilting of the projection, which is in the form of a finger, in the connecting terminal.

Further advantageous developments of the invention are defined in the dependent claims.

Exemplary embodiments of the invention are described in more detail in the following text with reference to the attached drawings, in which.

In FIGS. 1A to 9, identical components have the same reference symbols, and will thus not be described separately. To simplify the illustrations, FIGS. 3A, 4A, 7A, 8A each show one connecting terminal which is constructed in two parts for connection of two segments of a circuit board. The two parts of the connecting terminal are constructed identically, with a plan view of one part being shown, and a sectioned view of the other.

Figure 1A:
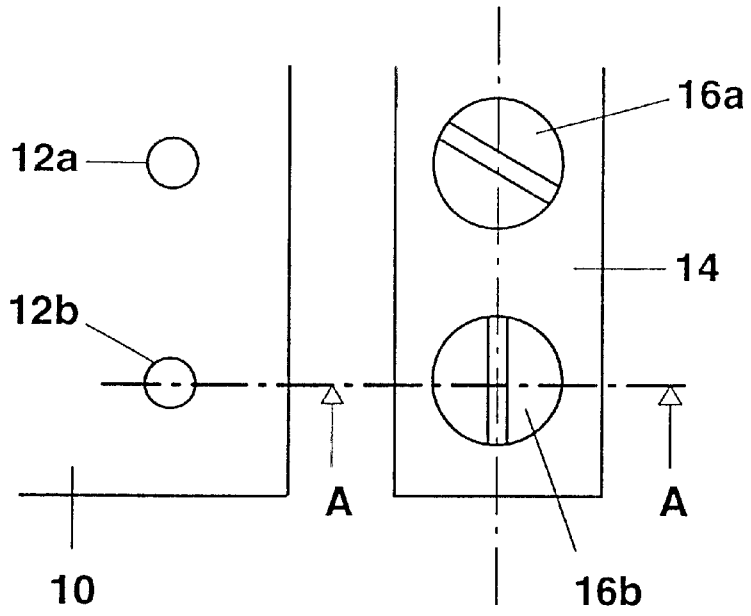
FIG. 1A Prior Art
FIG. 1A shows a plan view of a schematic illustration of a circuit board and of a connecting terminal according to the prior art.
Figure 1B:
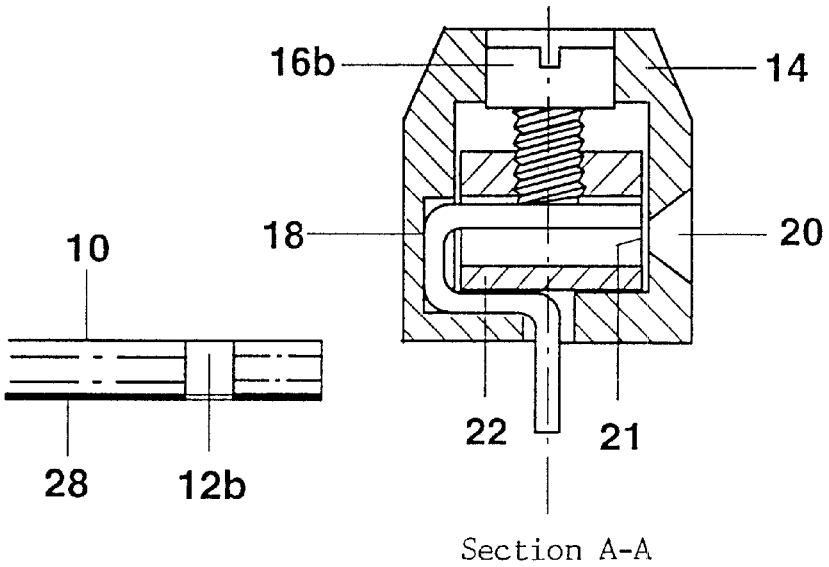
FIG. 1B Prior Art
FIG. 1B shows a view partially sectioned along the line A—A in FIG. 1A.
Figure 2A:
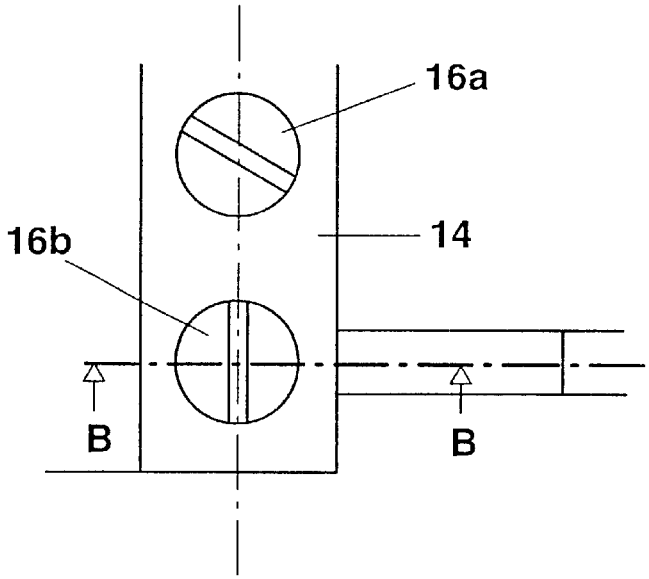
FIG. 2A Prior Art
FIG. 2A shows a view corresponding to FIG. 1A, in which the circuit board and a cable end have been inserted into the connecting terminal.
Figure 2B:
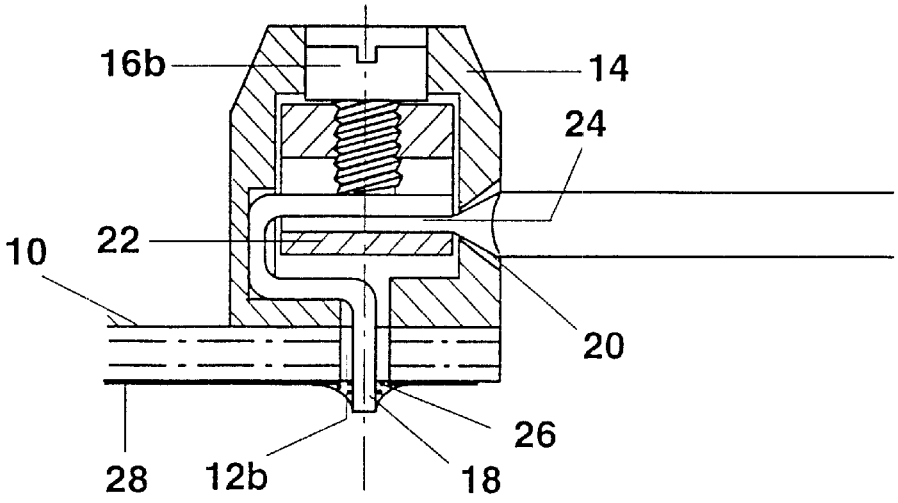
FIG. 2B Prior Art
FIG. 2B shows a view sectioned along the line B—B in FIG. 2A.
Figure 3A:
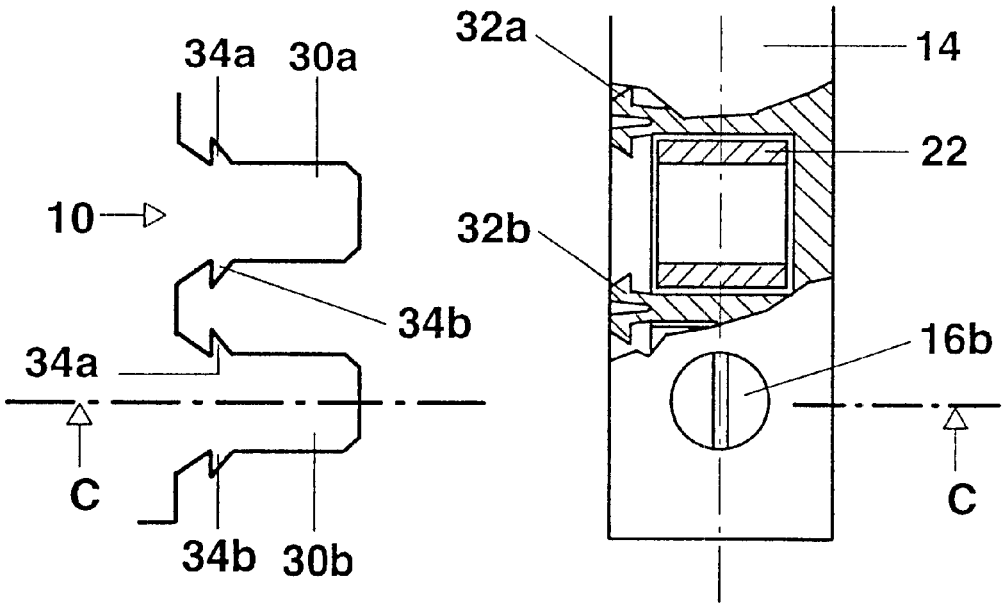
FIG. 3A shows a view, partially sectioned along the line D—D in FIG. 3B, of a connecting terminal according to the invention, as well as a part of a circuit board according to the invention.

FIG. 3A shows a partially sectioned view of a connecting terminal having a housing 14 which is intended for connection of two projections 30*a*,30*b*, in the form of fingers, on a circuit board 10. A lift cage 22, which can be moved relative to the housing 14 by means of a screw 16*b*, is provided for each connecting unit in the housing 14. Latching means 32*a*,32*b* are provided on the housing and interact with latching means 34*a*,34*b* on the projections 30*a*,30*b*, which are in the form of fingers, in order to fix the connection between the circuit board 10 and the housing 14 of the connecting terminal.

Figure 3B:
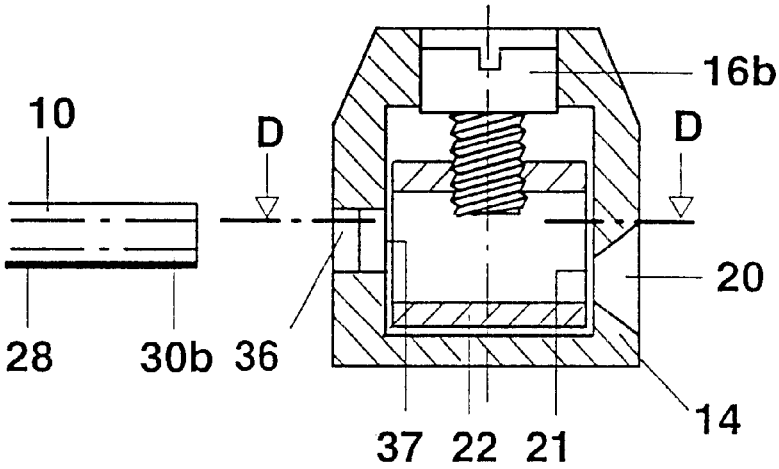
FIG. 3B shows a view partially sectioned along the line C—C in FIG. 3A.

FIG. 3B shows a section along the line C—C in FIG. 3A. Conversely, the sectioned part of FIG. 3A shows a view along the section line D—D in FIG. 3B.

It can be seen from FIG. 3B that the housing 14 has an opening 20 for feeding a cable end into, as well as an opening 36 for feeding a projection 30*a*,30*b* into, which projection is in the form of finger, on the circuit board 10. According to the illustration in FIG. 3B, the lift 22 can be moved upwards and downwards by rotating the screw 16*b*, by which means openings 21,37 in the lift cage 22 can be moved relative to the openings 20,36 in the housing 14.

Figure 4A:
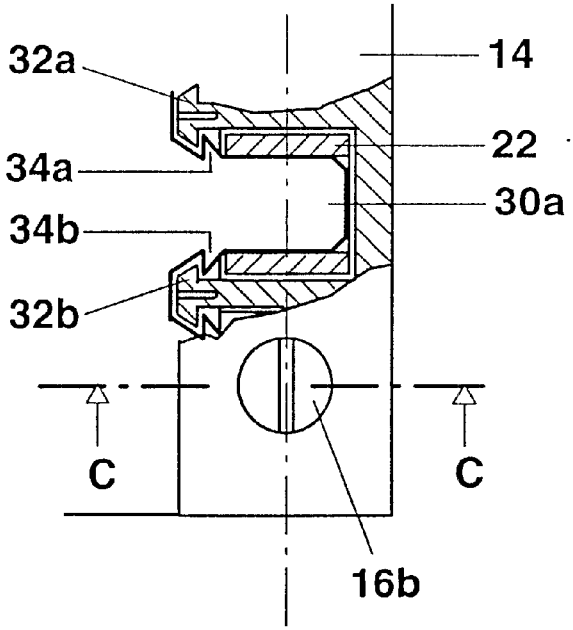
FIG. 4A shows a view, partially sectioned along the line D—D in FIG. 4B, of a connecting terminal according to the invention, after insertion of a circuit board according to the invention.

FIG. 4A corresponds to the view in FIG. 3B, but with the projection 30*a*, which is in the form of a finger, now having been inserted into the lift cage 22 through the opening 36 in the housing 14, which opening 36 is aligned such that it is flush with the opening 37 in the lift cage 22.

Figure 4B:
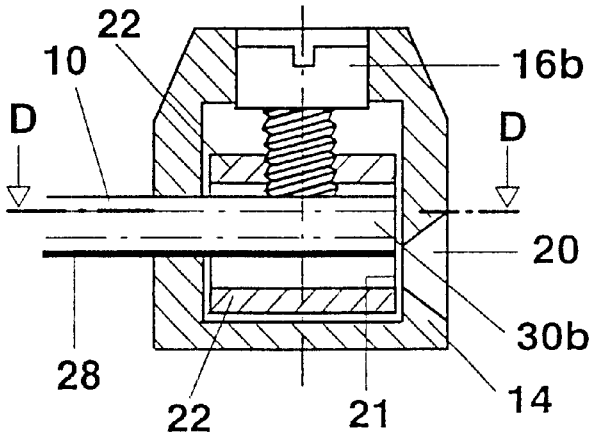
FIG. 4B shows a view sectioned along the line C—C in FIG. 4A.

FIG. 4B corresponds to FIG. 3B and shows a partially sectioned illustration of the cross section of the connecting terminal after the projection 30*b*, which is in the form of a finger, has been inserted into the lift cage 22.

Figure 5:
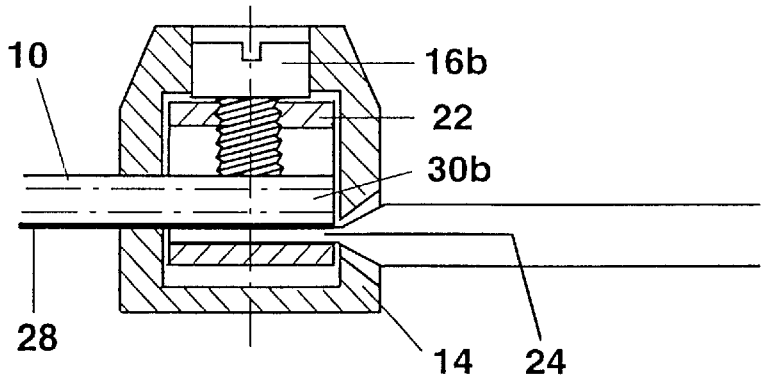
FIG. 5 shows a view, partially sectioned along the line C—C in FIG. 4A, with a cable end now being inserted into the connecting terminal, in addition to the circuit board.

FIG. 5 corresponds to FIG. 4B and now, also, shows the situation after a cable end 24 has been inserted through the openings 20 and 21, which are aligned such that they are flush, and the screw 16*b* has then been rotated in order to move the lift 22 upwards, in order in this way to connect the conductor track 28 electrically conductively to the cable end 24. The lift cage 22 can be fixed in this position owing to the pitch angle of the thread on the screw 16*b*.

Figure 6:
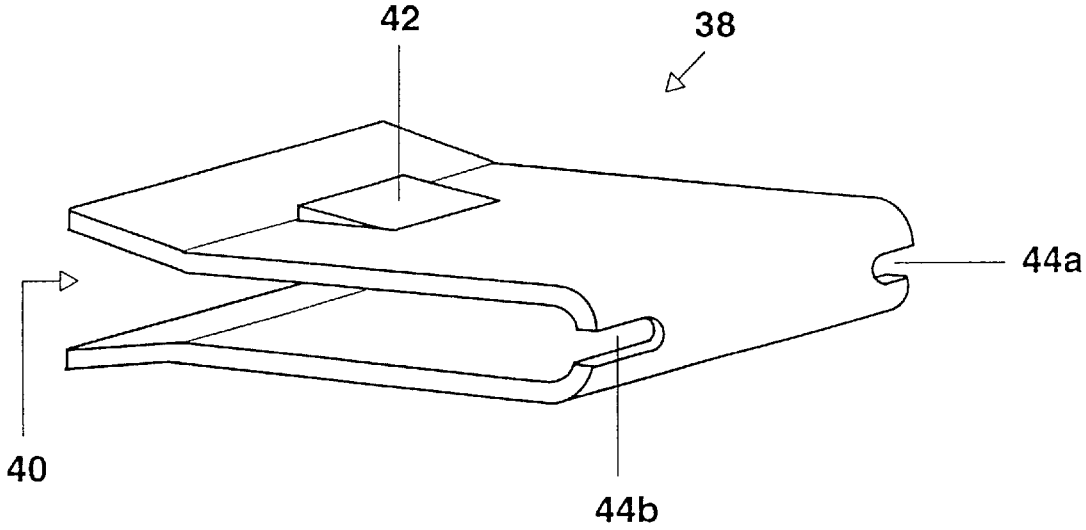
FIG. 6 shows a crushing protection device according to the invention.

FIG. 6 shows a U-shaped crushing protection device 38 as can be used, in particular, for connecting relatively weak circuit board material to a cable end by means of a connecting terminal according to the invention. The crushing protection device is preferably composed of resilient material, in particular electrically conductive material. It has a cavity 40 into which the projection, which is in the form of a finger, on the circuit board material can be inserted. Furthermore, on its upper and/or lower face, it has latching means 42 in order to fix it in the housing 14 of the connecting terminal. Two cutouts 44*a*,44*b* (see also FIG. 7A) are provided as tilting protection at its closed end, and interact with projections 46*a*,46*b* on the housing 14 of the connecting terminal in order to prevent the circuit board material from being tilted in the connecting terminal.

Figure 7A:
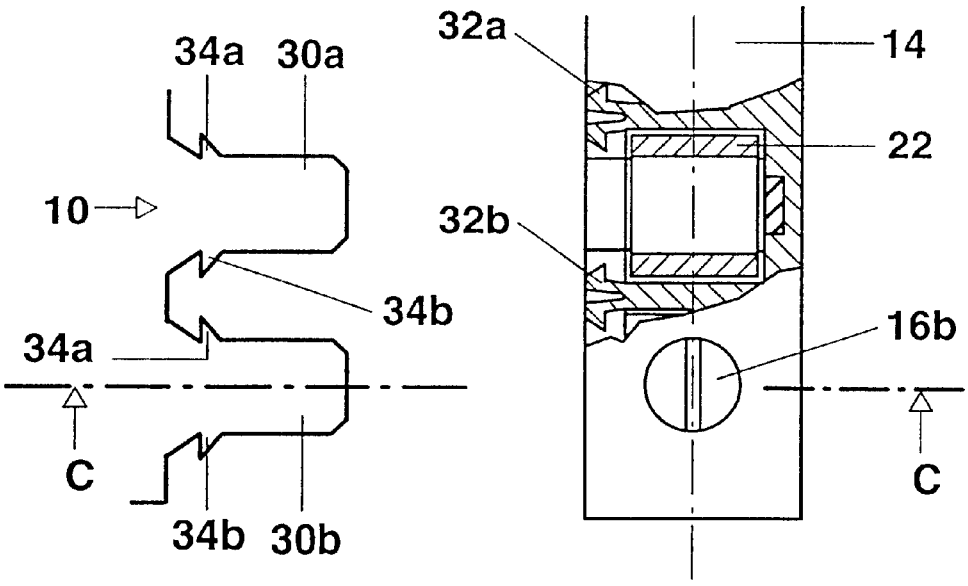
FIG. 7A shows a view, partially sectioned along the line D—D in FIG. 7B, of a connecting terminal according to the invention, as well as a part of a circuit board according to the invention.

FIG. 7A shows a partially sectioned view of a connecting terminal having a housing 14, which is intended for connection to two projections 30*a*, 30*b* which are in the form of fingers, on a relatively weak circuit board 10.

Figure 7B:
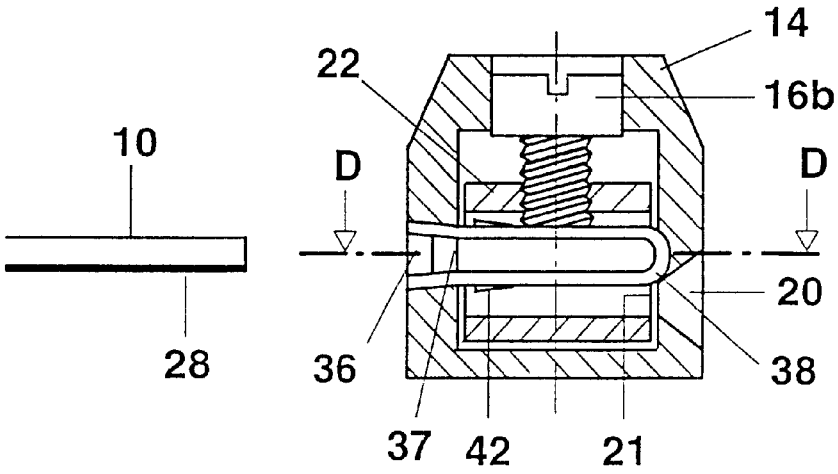
FIG. 7B shows a view partially sectioned along the line C—C in FIG. 7A.

FIG. 7B shows a section along the line C—C in FIG. 7A. Conversely, the sectioned part in FIG. 7A is a view along the section line D—D in FIG. 7B.

FIG. 7A shows a section through the closed end of the crushing protection device 38. FIG. 7B shows the crushing protection device 38 arranged in the housing 14 of the connecting terminal. The latching means 42 interact with the housing 14 and prevent the crushing protection device from falling out of the housing 14.

Figure 8A:
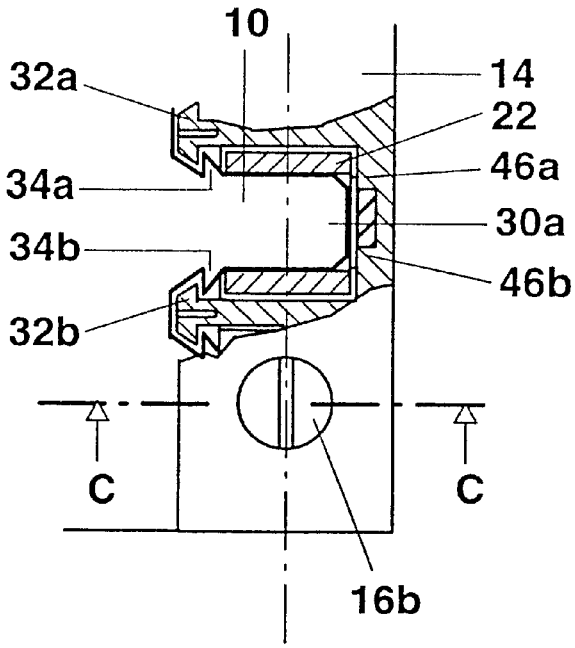
FIG. 8A shows a view, partially sectioned along the line D—D in FIG. 8B, of a connecting terminal according to the invention, after insertion of a circuit board according to the invention.

FIG. 8A corresponds to the illustration in FIG. 7A, with the projection 30*a*, which is in the form of a finger, on the circuit board 10 now having been inserted into the lift cage 22 in the connecting terminal.

Figure 8B:
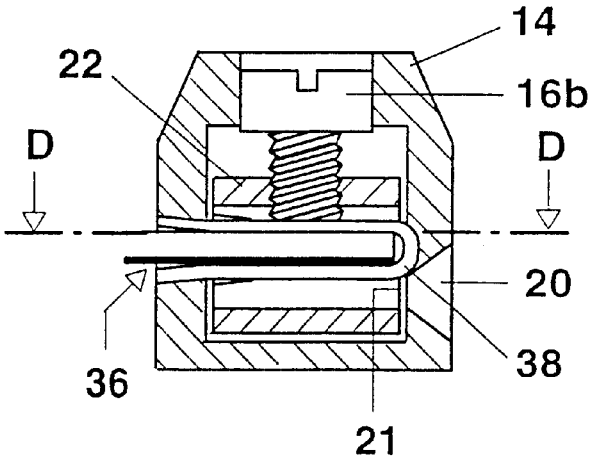
FIG. 8B shows a view partially sectioned along the line C—C in FIG. 8A.

FIG. 8B shows a cross section of this situation. It can clearly be seen that the crushing protection device 38 is connected to the housing 14 on both sides of the housing 14, in such a way that tilting is prevented.

Figure 9:
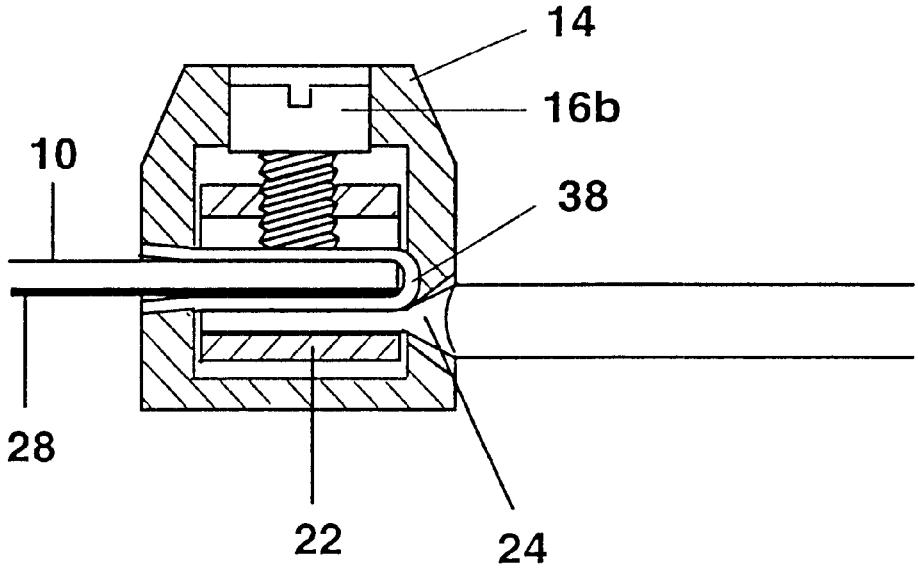
FIG. 9 shows a view, partially sectioned along the line C—C in FIG. 8A, with a cable end now being inserted into the connecting terminal, in addition to the circuit board.

FIG. 9 corresponds to the illustration in FIG. 8, but shows the situation after insertion of a cable end 24 and after rotation of the screw 16*b*, in order to electrically conductively connect, and fix, the combination of the crushing protection device 38, the circuit board 10 together with the conductor track 28 and the cable end 24.

The use of a crushing protection device 38 also offers the advantage that both sides of the circuit board may optionally be used for making contact, which results in a reduction in the contact resistance and allows contact to be made with the upper or lower face of the circuit board, optionally. In the embodiment which is illustrated in FIGS. 3A to 5, contact with the upper face of the circuit board 10 can be achieved by appropriate arrangement of the openings 36,20 and 37,21 respectively.

In embodiments which are not illustrated, the conductive connection of a conductor track on the circuit board 10 to a cable end 24 can be fixed by using a resilient snap-action mechanism. The snap-action mechanism can be operated by hand, or by means of a screwdriver.

What is claimed is:

1. A connecting terminal system comprising:

a connecting terminal having a housing in which a lift cage is arranged, the housing and the lift cage each having a first opening alignable for inserting a cable end into the lift cage, the housing and the lift cage each having a second opening alignable for inserting at least one part of a circuit board into the lift cage, the connecting terminal system further comprises a U-shaped crushing protection device disposed thereover for insertion into the connecting terminal in order to produce a conductive connection to the cable end.

2. The connecting terminal system according to claim 1, wherein the first and the second openings of the lift cage are designed and connected to one another or merge into one another in such a way that a conductive connection can be produced between the cable end and a conductor track on the part of the circuit board.

3. The connecting terminal system according to claim 2, wherein the lift cage is moveable with respect to the first and the second openings in the housing in such a way that the conductive connection between the cable end and the conductor track can be fixed.

4. The connecting terminal system according to claim 3, wherein the lift cage is moved by rotating a screw.

5. The connecting terminal system as claimed claim 1, wherein the first and the second opening are arranged on diametrically opposite sides of the housing and of the lift cage.

6. The connecting terminal system according to claim 1, wherein the first and the second openings are arranged on the same side of the housing and of the lift cage and are formed by a common opening.

7. The connecting terminal according to claim 1, wherein the housing has latching means which interact with the at least one part of the circuit board which is used for fixing the connection between the circuit board and the housing.

8. The connecting terminal system according to claim 1, wherein the crushing protection device has a tilting protection apparatus which prevents tilting of the at least one part of the circuit board which is inserted into the connecting terminal.

9. The connecting terminal system according to claim 8, wherein the tilting protection apparatus comprises at least one cut-out which interacts with at least one projection in the housing of the connecting terminal.

10. The connecting terminal system according to claim 1, wherein the crushing protection device is produced from an electrically conductive or resilient material.

11. The connecting terminal system according to claim 1, wherein the crushing protection device has latching means which interact with the housing in order to fix the crushing protection device in the housing.

* * * * *